United States Patent [19]

Stackhouse

[11] 3,974,669

[45] Aug. 17, 1976

[54] LOCK

[75] Inventor: Wells F. Stackhouse, Ashville, N.Y.

[73] Assignee: American Locker Company, Inc., Jamestown, N.Y.

[22] Filed: Aug. 25, 1975

[21] Appl. No.: 607,682

[52] U.S. Cl. ..... 70/276; 70/20; 70/413

[51] Int. Cl.[2] ..... E05B 47/00; E05B 47/04; E05B 51/00; E05B 67/38

[58] Field of Search ..... 70/276, 413, 20, 38 C, 70/282

[56] References Cited

UNITED STATES PATENTS

| | | | |
|---|---|---|---|
| 3,552,159 | 1/1971 | Craig | 70/413 X |
| 3,633,393 | 1/1972 | Hisatsune | 70/413 X |
| 3,657,907 | 4/1972 | Boving | 70/38 C |
| 3,742,739 | 7/1973 | Hickman | 70/276 X |
| 3,857,262 | 12/1974 | Sidiropoulos | 70/276 |
| 3,901,057 | 8/1975 | Coley | 70/20 |

*Primary Examiner*—J. Franklin Foss
*Attorney, Agent, or Firm*—Bean & Bean

[57] ABSTRACT

A lock, such as a padlock, is provided with a single, spring biased end journaled bolt for operably interconnecting a shackle with a magnetic key controlled, locking-unlocking mechanism.

8 Claims, 14 Drawing Figures

Fig. 4a.
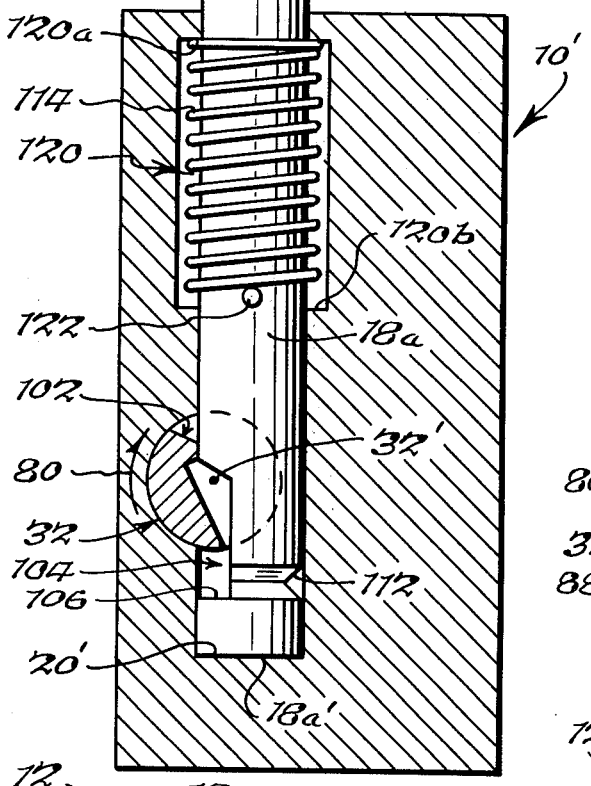
Fig. 4b.
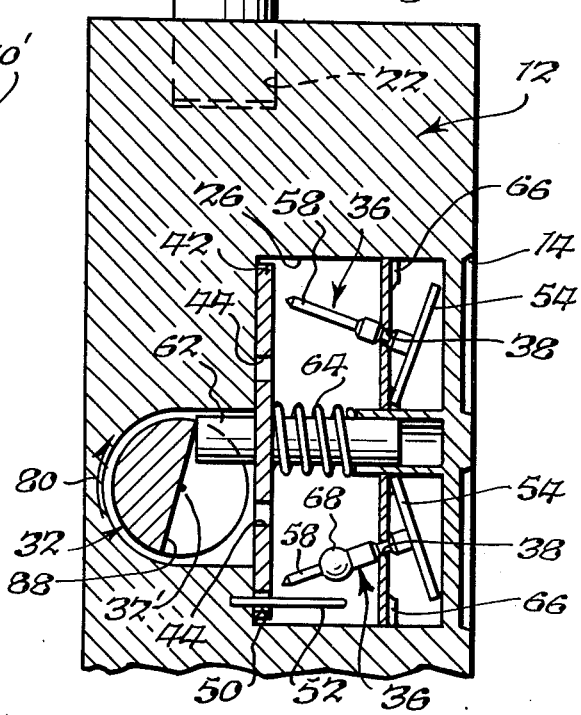
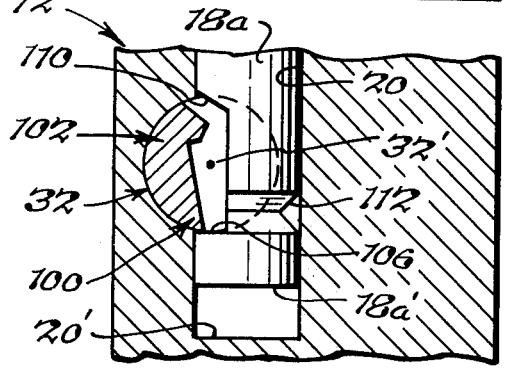
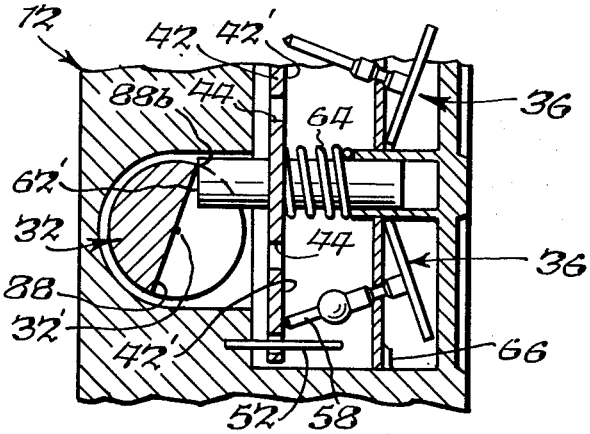
Fig. 4a'.
Fig. 4b'.
Fig. 4a''.
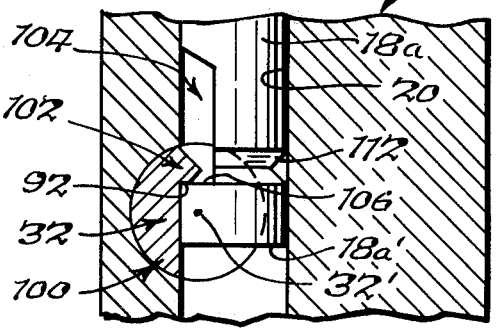
Fig. 4b''.
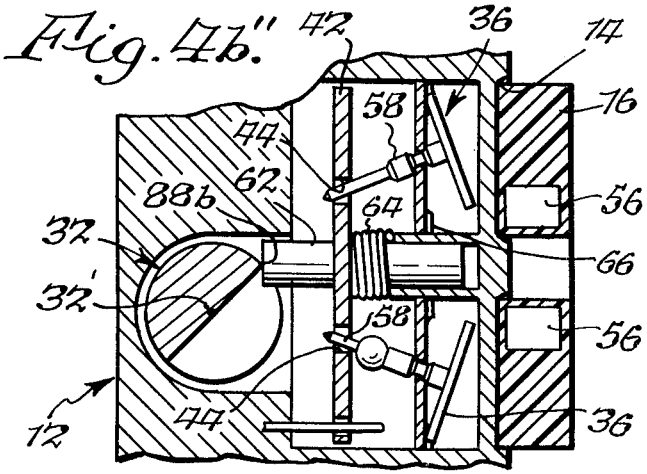

LOCK

BACKGROUND OF THE INVENTION

Various forms of magnetic key operated padlocks have heretofore been proposed, as evidenced by U.S. patents to Hisatsune U.S. Pat. No. 3,633,393 and Boving U.S. Pat. No. 3,657,907. These prior locks are believed to possess one or more disadvantages including complex construction resulting in unacceptable manufacturing costs, and operating mechanisms, which may be readily damaged during normal use and/or which reduce the structural integrity of the lock.

SUMMARY OF THE INVENTION

The present invention is directed towards a simplified structure, which is adapted for use in operably interconnecting a shackle of a padlock or bolts of diverse type locks with an operator actuated locking-unlocking mechanism.

The present lock construction may employ a magnetic key controlled shackle locking-unlocking mechanism of the general type disclosed in U.S. Pat. No. 3,657,907 and in my co-pending patent application Ser. No. 577,449 entitled Magnetic Lock and filed May 14, 1975 from the standpoint that it includes an apertured locking plate or member arranged in association with a plurality of tumbler pins, which are pivotally supported intermediate their ends and alignable with apertures of the plate only when a proper magnetic key is applied to the lock. Alignment of the tumbler pins with their associated apertures releases the locking plate for movement between its locking and unlocking positions.

The present construction features a novel arrangement by which the feeler plate is operably interconnected with the shackle by means of a single bolt rotatable relative to both the feeler plate and the shackle. The construction of the present invention permits the bolt to be of a relatively large diameter and to be journaled adjacent its opposite ends, so as to maximize the strength of the lock at those points thereof subjected to the greatest load.

Two forms of the invention will be disclosed in detail; such forms being of essentially identical construction, but differing in mode of operation, thereby to permit unlocking movements of a shackle to be initiated by either the application of pushing or pulling forces thereto.

While the present construction will be primarily described with reference to its use in association with padlocks, wherein the locking-unlocking mechanism is of the magnetic responsive variety, it is considered as having more general application.

DRAWINGS

The nature and mode of operation of the present invention will now be more fully described in the following detailed description taken with the accompanying drawings wherein:

FIG. 1 is a perspective view showing a padlock incorporating the present invention in association with a magnetic key to be employed in operating the padlock;

FIGS. 2*a* and 2*b* are sectional views taken generally along the corresponding numbered lines in FIG. 1 and showing elements of the lock in a "rest", locked condition;

FIGS. 2*a*′ and 2*b*′ are views similar to FIGS. 2*a* and 2*b*, respectively, but show the lock elements in a wrong key presented, attempted opening blocked condition;

FIGS. 2*a*″ and 2*b*″ are similar to FIGS. 2*a* and 2*b*, respectively, but show the lock elements in an unlocked condition;

FIG. 3 is a fragmentary sectional view taken generally along line 3—3 in FIG. 1; and FIGS. 4*a*–4*b*″ are views similar to FIGS. 2*a*–2*b*″, respectively, but show an alternative lock construction.

DETAILED DESCRIPTION

Figure 1:
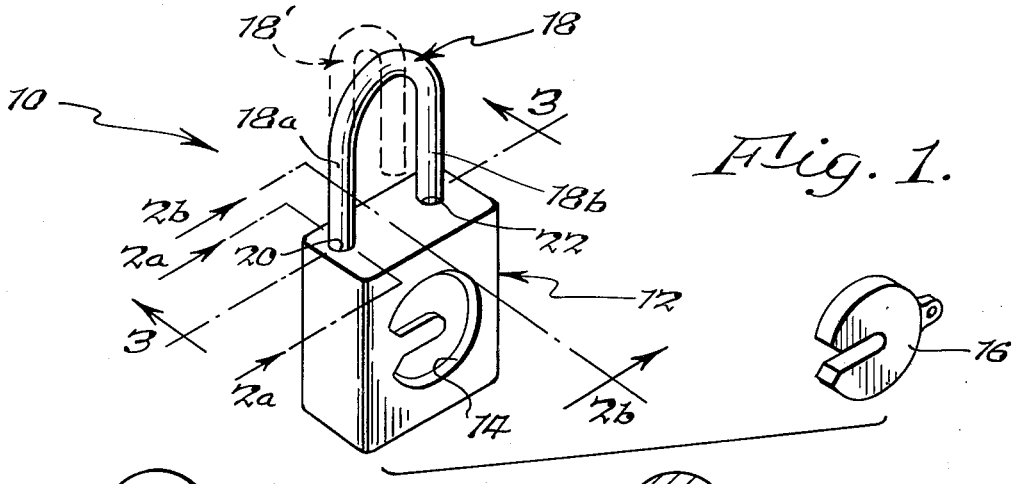

The present invention will now be described with particular reference to its use in the padlock of the type generally designated as 10 in FIG. 1. Padlock 10 is conventional from the standpoint that it includes a lock casing or housing 12 having a recess 14 shaped or configured to positionally receive or orient a magnetic key or operator 16 relative to casing 12, and a shackle or other lockable member 18 movably supported by casing 12. Shackle 18 is shown as being of a generally J-shaped configuration formed in part by a main leg portion 18*a*, which is permanently secured within lock casing bore opening 20 for both rotational and limited axial reciprocating movements, and a minor leg portion 18*b*, which is removably locked within lock casing blind recess or bore opening 22.

Lock casing 12 is also formed with an internal cavity 26, which is arranged in communication with opening 20 and serves to receive operator actuated, magnetically controlled locking-unlocking mechanism 30 and a coupling bolt 32, which serves to operably interconnect mechanism 30 and shackle leg portion 18*a* in the manner to be described. By specific reference to FIG. 2*b*, it will be understood that mechanism 30 is disposed in operative alignment with recess 14, but separated therefrom by a relatively thin partition wall 34 formed of a non-magnetic material.

Figure 2A:
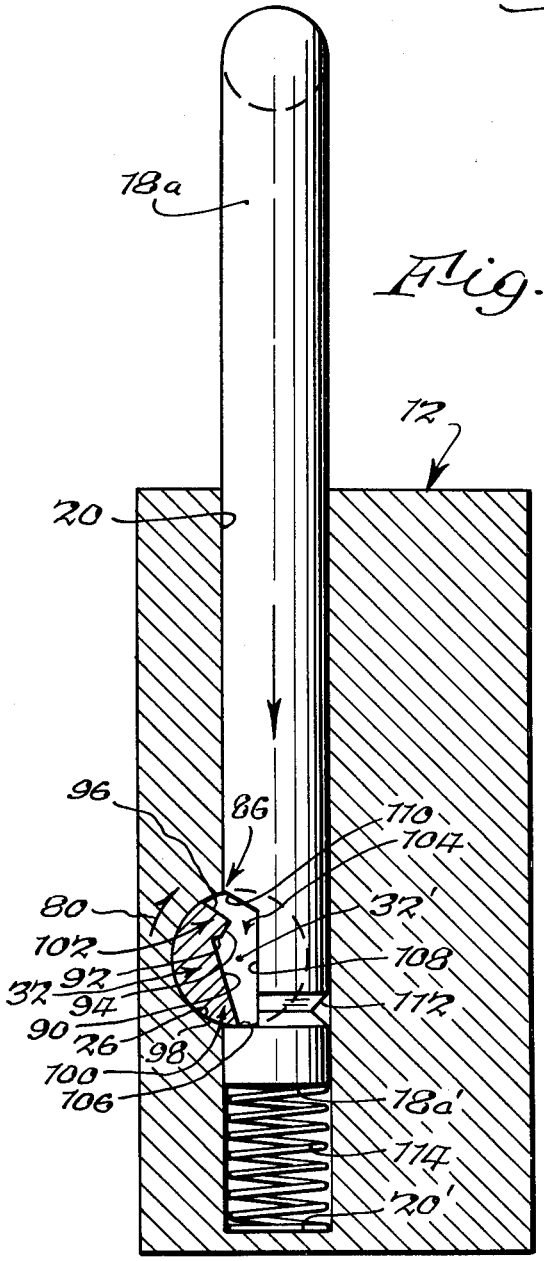
Figure 2B:
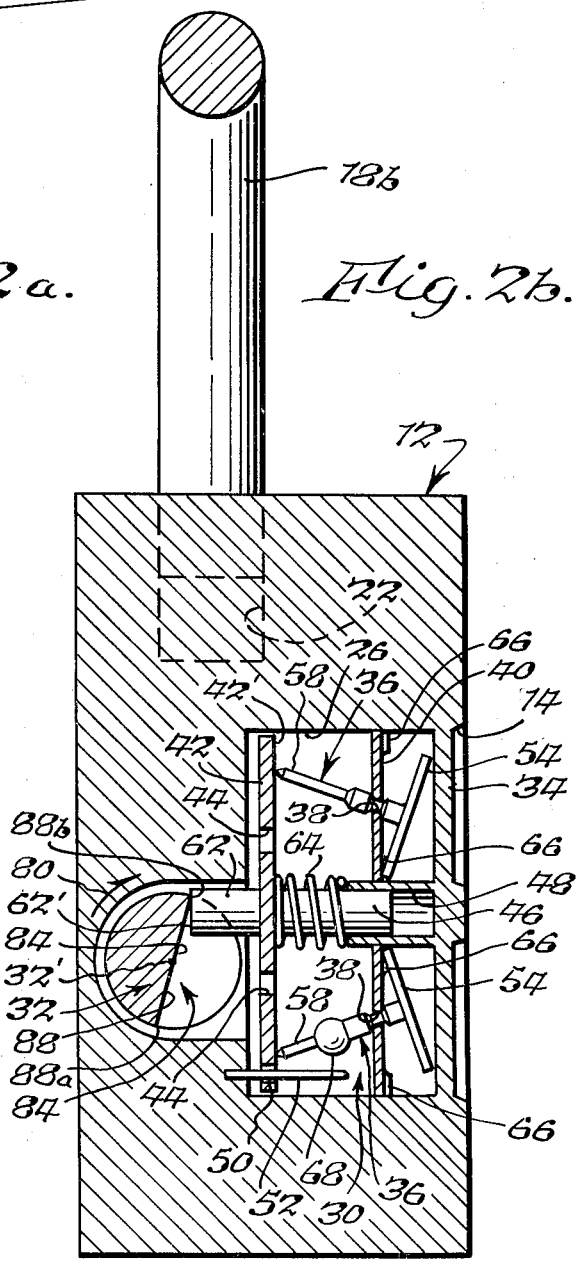
Figure 2A:
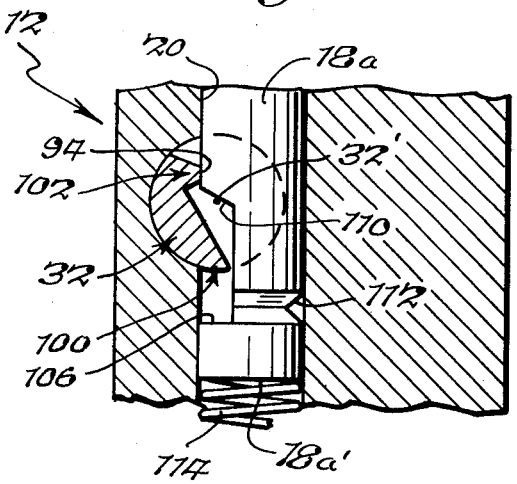
Figure 2B:
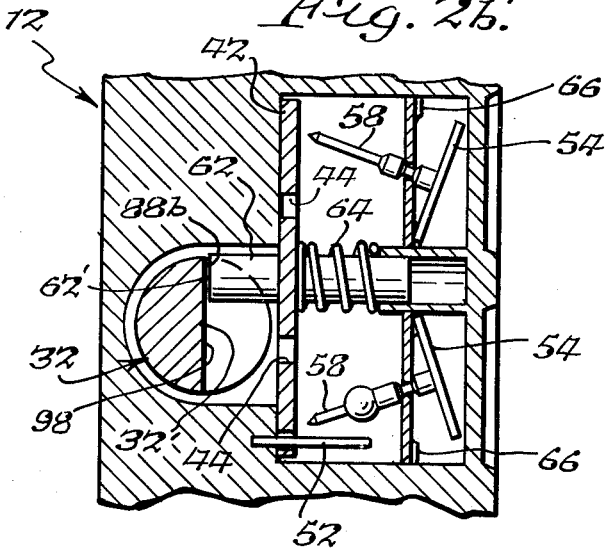
Figure 2B:
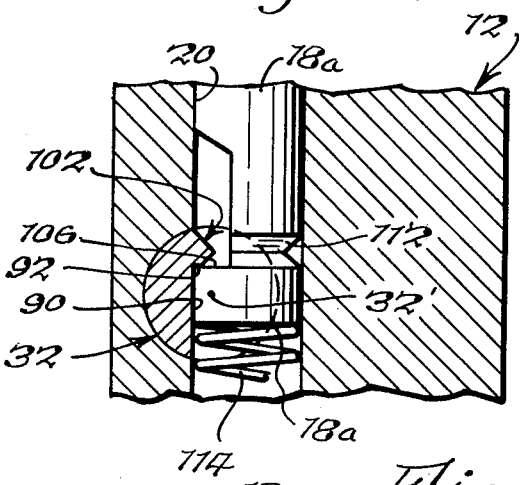
Figure 2B:
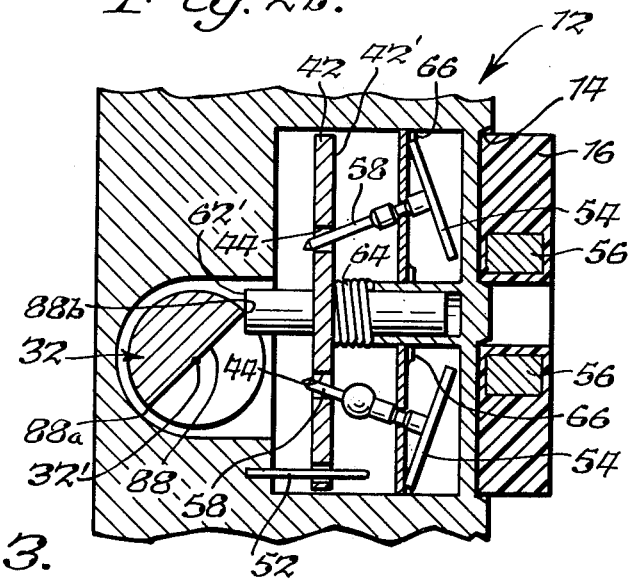

Mechanism 30 comprises one or more tumbler pins 36, which are supported intermediate their ends within bearing openings 38 of a stationary mounting plate 40 for essentially universal pivotal or tilting movements; and a locking plate or member 42, which is formed with apertures 44 arranged for association one with each of tumbler pins 36 and suitably guided or constrained for reciprocating movements in a direction normal to plate 40 between the locking and unlocking positions shown in FIGS. 2*b*′ and 2*b*″, respectively, through a rest-locked or intermediate position shown in FIG. 2*b*. As by way of example, locking plate 42 may be guided for reciprocating movements by forming it with an outwardly projecting guide pin 46 dimensioned to be slidably received within a partition wall mounted guide sleeve 48 and with a guide opening 50 sized to slidably receive a casing mounted guide pin 52.

Tumbler pins 36 may be considered as having outer end portions 54, which are adapted to be magnetically attracted by associated magnet devices 56 encapsulated within key 16 formed of non-magnetic material, as indicated in FIG. 2*b*″, and relatively pointed inner or locking end portions 58, which are dimensioned to be received within associated ones of locking plate apertures 44, when the tumbler pins are caused to assume "predetermined combination setting" positions established by the placement of magnet devices 56 within a proper key 16 inserted within recess 14. Locking plate 42 is also formed with an inwardly projecting operating pin or member 62. which is arranged for engagement with bolt 32. An additional spring device, such as coil spring 64 arranged concentrically of guide pin 46 intermediate plates 40 and 42, normally serves to bias the locking plate towards its fully locked position shown in FIG. 2*b'*.

In a preferred construction, which is disclosed and claimed specifically in my above mentioned copending application, the magnetically attractable portions 54 of tumbler pins 36 are disc shaped and enlarged to extend transversely of the axis of the tumbler pins, and mounting plate 40 is provided with a plurality of upstanding wedges or otherwise formed support surfaces 66. Wedges 66 are arranged in groups of wedges associated one group with each mounting plate bearing opening 38, wherein the wedges of each group extend essentially radially of their associated bearing opening and are equally spaced apart annularly thereof. If desired, the tumbler pins may be nonuniformly biased to assume different orientations relatively to mounting plate 40 for any given orientation of lock 10, as for instance by forming the locking end portions 58 of certain of the tumbler pins with an enlargement 68. This arrangement renders the lock more difficult to pick, since the tumbler pins always tend to assume differing orientations under the influence of gravity.

Normally, the number of magnet devices 56 and the number of locking plate apertures 44 of a set combination, lock construction will be determined by the number of tumbler pins 36 provided in mechanism 30, whereas the orientation of such magnet devices within the key will be determined by the placement of locking plate apertures 44. In the illustrated construction, associated ones of apertures 44 and magnet devices 56 are disposed in essential alignment and arranged to lie in some predetermined angular position along circular paths whose centers are disposed in alignment with an axis passing through the mounting plate bearing opening 38 of their associated tumbler pin.

As by way of specific example, mechanism 30 may employ four tumbler pins, thereby requiring four magnet devices 56 to be imbedded within separate areas of key 16. The magnet devices, tumbler pins and locking plate apertures would be sized to provide for each tumbler pin a given number of distinct and equally spaced "possible combination setting" positions, and a like number of wedges or support surfaces would be associated with each mounting plate bearing opening, such that the wedges would be essentially equally spaced angularly of their associated mounting plate bearing openings and disposed between adjacent "possible combination setting" positions. Of course, it is preferable to utilize differently orientated "predetermined combination setting" positions for the several tumbler pins, so as to render the lock more difficult to pick and to prevent random tilting movements of mechanism 30 from simultaneously placing all of the tumbler pins in alignment with their associated locking plate aperture.

By now referring to FIG. 2*b'*, it will be understood that when locking plate 42 is disposed in its fully locked position, the tumbler pins are free to pivot within their respective mounting plate openings 38 under the influence of gravity and/or another suitable bias in the absence of key 16 within recess 14. However, due to the weight of their disc shaped head end portions 54 and/or enlargements 68, the tumbler pins tend to tilt relative to mounting plate 40 or "fall over" such that the rims of their head end portions 54 engage with pairs of adjacently disposed wedges 66. The thus engaged wedges cooperate with their associated mounting plate openings 38 to provide "three point" supports for the tumbler pins, thereby causing each locking end portion 58 to "point" towards one of the "possible combination setting" positions of its associated locking plate aperture, which on average is not the actual or "predetermined combination setting" position of such locking plate aperture.

When one or more of the tumbler pins are not arranged in their "predetermined combination setting" positions, the locking end portions of such tumbler pins are not aligned with their associated locking plate apertures 44 and thus will engage with the outwardly facing or locking surface 42' of locking plate 42 in order to prevent movement of the locking plate towards its unlocked position shown in FIG. 2*b''* beyond its rest-locked position shown in FIG. 2*b*. However, when a proper key 16 is arranged within recess 14, and locking plate 42 is disposed in its fully locked position, all of the tumbler pins are attracted by their associated magnet devices 56 and thereby caused to assume their "predetermined combination setting" positions, wherein their locking end portions 58 are arranged to "point" towards their associated locking plate apertures 44. When this occurs, locking plate 42 is "released" and may be pushed against the return bias of spring 64 into its unlocked position shown in FIG. 2*b''*, wherein locking end portions 58 are received within or inserted through their associated locking plate apertures 44.

Figure 3:
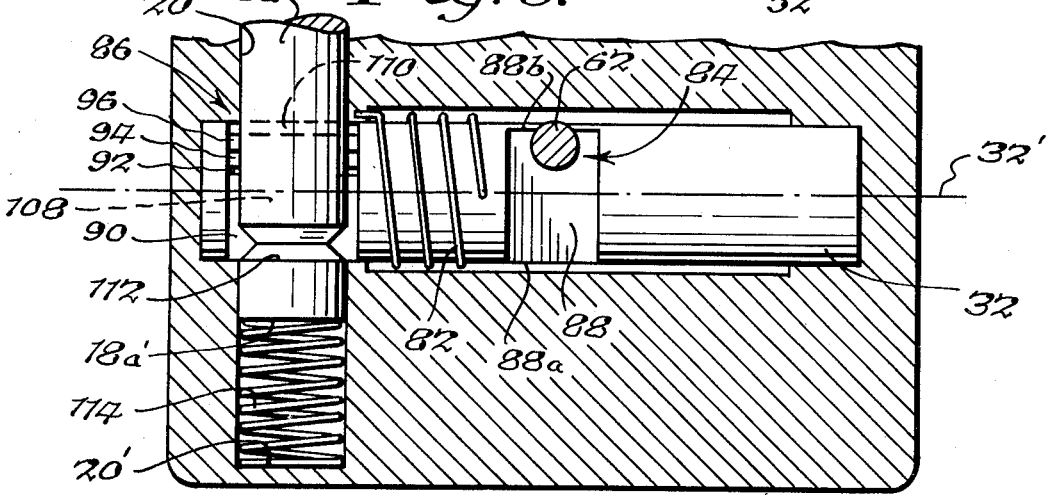

Now referring to FIGS. 2*a*, 2*b* and 3, it will be understood that in accordance with the present invention bolt 32 is preferably journaled adjacent its opposite ends by the walls of casing 12 for rotation about its axis 32' between first and second rotatable positions shown in FIGS. 2*a'* and 2*a''*, respectively, through a rest-locked or intermediate position shown in FIG. 2*a*. Bolt 32 is continuously biased for rotation in a clockwise direction, as indicated by arrows 80 in FIGS. 2*a* and 2*b* by suitable means, such as a coil spring 82; spring 82 tending to exert on locking plate 42, via bolt 32 and pin 62, a relatively stronger spring force than that exerted by spring 64.

Bolt 32 is also preferably shaped to define axially spaced cam areas 84 and 86, which are disposed for cooperating engagement with operating spin 62 and shackle leg portion 18*a*, respectively. Cam area 84 is shown as being in the form of an essentially planar surface 88, which is transversely bounded by edges 88*a* and 88*b* and arranged for cooperative engagement with the generally planar end surface 62' of operating pin 62. Alternately, bolt 32 may be substantially shortened from that shown in FIG. 3 so as to permit cam area 84 to be defined by a locking plate engaging cam pin, not shown, which would project from the end of the bolt and be disposed eccentric to its axis 32', such as to move along an arcuate path as the bolt is rotated. In effect, such cam pin would functionally replace surface 88 and edge 88*b*.

Cam area 86 is shaped to define adjacently disposed, relatively inclined and essentially planar clearance, shackle stop, bolt stop and bolt cam surfaces 90, 92, 94 and 96, respectively. Clearance surface 90 cooperates with an adjacently disposed portion of the cylindrical surface 98 of bolt 32 to define a stop portion 100, whereas surfaces 92, 94 and 96 cooperate to define a cam-stop portion 102. By referring to FIGS. 2*a* and 2*b*, it will be understood that bolt 32 is formed such that cam surface 88 extends essentially radially through bolt axis 32', whereas stop portion 100 and cam-stop portion 102 are arranged to lie on one side of a plane passing through such axis. In the illustrated construction, clearance surface 90 is disposed at an angle of approximately 45° relative to cam surface 88, and the parts of lock 10 designed such that bolt 32 is rotated through approximately 45° during movement between its first and second rotatable positions.

Now making particular reference to FIGS. 2*a*–2*a''*, it will be seen that shackle leg portion 18*a* is shaped to define a side opening recess or slot 104 having a transversly extending stop surface 106, and axially extending clearance surface 108 and an inclined, generally transversely extending cam surface 110; and an annularly extending, generally V-shaped guide groove 112 having its opposite ends communicating with notch 104 adjacent stop surface 106. Also by reference to these Figures, it will be understood that a suitable compression spring device, such as a coil spring 114 arranged intermediate the inner end 20' of bore opening 20 and the inner end 18*a'* of shackle leg portion 18*a*, is employed to continuously bias the shackle towards an open or unlocked position shown in FIG. 2*a''*, which may be defined for instance by engagement of stop surface 106 with cam-stop portion 102. In this position of the shackle, shackle leg portion 18*b* is withdrawn from within casing bore opening 22 and groove 112 is arranged in alignment with cam-stop portion 102, whereby to free shackle leg portion 18*a* for rotational movements about its axis relative to bolt 32, as indicated to phantom line at 18' in FIG. 1, while preventing further withdrawal from bore opening 20. When shackle leg portion 18*b* is repositioned in alignment with casing bore opening 22, shackle leg portion 18*a* may be manually moved inwardly against the bias of spring 114 into its innermost or locked position shown in FIG. 2*a'*, which may be variously defined as for instance by having shackle leg portion 18*b* bottom out within its bore opening 22 or by having the inner end 18*a'* of shackle leg portion 18*a* bottom out on fully compressed spring 114. In any event when manual pressure is removed from shackle 18, spring 114 normally serves to return shackle leg portion 18*a* into its rest-locked position shown in FIG. 2*a*, which is defined by engagement of stop surface 106 with bolt stop portion 100; bolt 32 and locking plate 42 being returned to their respective rest-locked positions under the bias of spring 82 during movement of leg portion 18*a* between its positions shown in FIGS. 2*a'* and 2*a*. In this rest-locked position of shackle leg portion 18*a*, shackle leg portion 18*b* remains locked within the confines of bore opening 22.

Operation of the first embodiment of the present invention will now be described by first making reference to FIGS. 2*a* 2*b*, wherein mechanism 30, bolt 32 and shackle leg portion 18*a* are shown as being disposed in their rest-locked positions with key 16 being removed from recess 14. Thus, tumbler pins 36 of mechanism 30 reside in position previously established by the bias of the weight of head end portions 54 and/or enlargement 68, which normally do not correspond to their "predetermined combination setting" positions established by magnet devices 56, such that their locking end portions 58 engage with locking surface 42' out of alignment with their associated locking plate apertures 44. Locking plate 42 is maintained in locking engagement with locking end portions 58, that is in its rest-locked position, against the bias of return spring 64 by the stronger bias exerted on bolt 32, and thus the locking plate, by coil spring 82. In this rest-locked position of the parts, any attempt to withdraw or move leg portion 18*a* into its unlocked position will be resisted by engagement between stop surface 106 and stop portion 100, as indicated in FIG. 2*a*. Preferably, the parts are designed and arranged such that the point or line of engagement between stop surface 106 and stop portion 100 is either essentially aligned with the bolt axis 32' in the direction of movement of shackle leg portion 18*a* or to the "right" of such axis, as viewed in FIG. 2*a*. Thus, manually applied force attempting an unauthorized movement of shackle 18 into its unlocked position is resisted solely by bolt 32, and does not develop a torque on the bolt, which would result in a deforming pressure being applied to tumbler pins 36. Accordingly, the tumbler pins may be of relatively light weight construction in that they are only required to resist a deforming force corresponding essentially to the difference between the forces exerted by springs 64 and 82. Further, when the parts of the lock are in this rest-lock position, any attempt to push leg portion 18*a* further into bore opening 20 will simply cause cam surface 110 to be drivingly engaged with cam surface 96 of cam-stop 102 and thereby cause bolt 32 to rotate in a counterclockwise direction into its fully locked position shown in FIGS. 2*a'* and 2*b'*. While the resultant removal of locking plate surface 42' from engagement with locking end portion 58 of tumbler pins 36 under the bias of spring 64 will permit the tumbler pins to swing freely under the bias of gravity, there will be no tendency for such pins to assume their "predetermined combination setting" positions absent the insertion of key 16 within recess 14. If a proper key 16 is not inserted into recess 14 at this point in time, spring 114 will serve to return the parts to their rest-locked positions upon removal of inwardly directed manual force from shackle 18. If on the other hand, a proper key 16 is inserted in recess 14 while leg portion 18*a* is fully depressed or disposed in its locked position, the tumbler pins will automatically assume their "predetermined combination setting" positions, and subsequently permit spring 82 to drive locking plate 42 into its unlocking position shown in FIG. 2*b''* when leg portion 18*a* has been moved outwardly by the bias of spring 114 sufficiently to place recess 104 in alignment with cam-stop portion 102. It will be understood that the distance between the rest-locked position and the unlocking position of locking plate 42, which may be determined by the fully compressed state of spring 64, permits bolt 32 to be rotated by spring 82 in a clockwise direction past its rest-locked position shown in FIG. 2*a* sufficiently to remove stop portion 100 from within shackle leg portion recess 104. Thus, shackle leg portion 18*a* is freed for movement past its normal rest-locked position shown in FIG. 2*a* into its unlocked position shown in FIG. 2*a''*, wherein surface 106 engages with stop surface 92. While the point or area of contact between stop surface 106 and stop surface 92 is slightly offset relative to bolt axis 32' in the direction of reciprocation of shackle leg portion 18*a*, this will, however, not result in further rotation of bolt 32 due to the constraint afforded by engagement of clearance surface 90 with the cylindrical surface of shackle leg portion 18*a* intermediate recess 104 and shackle portion inner end 18*a'*.

When it is desired to again lock shackle leg portion 18*b* within casing bore opening 22, shackle leg portion 18*a* is simply forced towards its fully locked position shown in FIG. 2*a'* against the bias of spring 114 in the absense of a proper key being inserted within recess 14. Upon insertion of shackle leg 18*a* sufficiently for cam surface 110 to cam stop-cam portion 102 from within recess 104 and place surface 94 for engagement with the cylindrical side wall of shackle leg portion 18*a*, as indicated in FIG. 2*a'*, additional spring 64 is effective to drive the locking plate 14 into fully locked position shown in FIG. 2*b'*, whereby to free tumbler pins 36 for gravity induced movement from alignment with their associated locking plate apertures 44. When manually applied pressure is subsequently released, spring 114 returns shackle leg portion 18*a* to its rest-locked position shown in FIG. 2*a*.

Thus, the first embodiment of the present invention is characterized by the requirement that the shackle be pushed in when a proper key is present in recess 14 to effect unlocking thereof and be subsequently pushed in in the absence of a proper key to again effect locking thereof.

An alternative form of the present invention is shown in FIGS. 4*a*–4*b''*, wherein the various elements of lock 10' are identical to those described in FIGS. 2*a*–2*b''* with reference to lock 10 with the exceptions that bore opening 20 is stepped to define a concentrically arranged cavity 120, which is axially or opposite end bounded by surfaces 120*a* and 120*b*, and that spring 114 is arranged within cavity 120 to opposite end bear on surface 120*a* and a pin 122, fixed to shackle leg portion 18*a*. In this embodiment, spring 114 is employed to continuously bias shackle leg portion 18*a* towards its fully inserted or locked position shown in FIG. 4*a*, which may be variously defined, as for instance by arranging pin 122 to abut against cavity wall 120*b* or by engagement of shackle leg portion inner end 18*a'* with bore opening inner end 20'. The resultant positioning of shackle leg portion 18*a*, bolt 32 and locking plate 42 in FIGS. 4*a* and 4*b* is identical to the fully locked position of these parts as shown in FIGS. 2*a'* and 2*b'* and described with reference to lock 10. The parts of lock 10' normally assume their positions shown in FIGS. 4*a* and 4*b* under the bias of spring 114, wherein shackle leg portion 18*a* is constrained from further inwardly directed movement and tumbler pins 36 are free from contact with locking plate 42, such that they are free to pivot or tilt under either the influence of gravity or magnet devices 56.

Operation of lock 10' is characterized by the requirement that a pulling force be exerted on shackle 18 after the proper key 16 has been inserted to recess 14 in the manner indicated in FIG. 4*b''* for the purpose of prearranging tumbler pins 36 in their respective "predetermined combination setting" positions. With the tumbler pins so arranged, a continuous pulling force applied to shackle 18 will cause the parts to assume their fully unlocked positions shown in FIGS. 4*a''* and 4*b''*.

After shackle 18 has been moved to its unlocked or open position and shackle leg portion 18*a* rotated within bore opening 20 to remove shackle leg portion 18*b* from alignment with bore opening 22, engagement of cam-stop portion 102 within groove 112 will serve as a latch preventing return movements of the shackle towards its locked condition under the bias of spring 114. When it is desired to return shackle 18 to its locked position, it is merely necessary to re-orient shackle leg portion 18*b* with bore opening 22, whereupon cam-stop portion 102 is removed from latching engagement within groove 112 and spring 114 is operative to automatically return the parts of lock 10' to their positions shown in FIGS. 4*a* and 4*b*.

If an attempt is made to open lock 10' without first inserting proper key 16 within recess 14, the tumbler pins will not be prearranged in their "predetermined combination setting" positions. Therefore, locking plate surface 42' will engage with locking end portions 58 and constrain the locking plate from movement beyond an intermediate position thereof shown in FIG. 4*b'*, which corresponds to the rest-locked position it assumes in lock 10. This in turn will prevent rotation of bolt 32 under the influence of spring 82 beyond its intermediate position shown in FIGS. 4*a'* and 4*b'*. When this occurs, stop portion 100 is not withdrawn from within recess 104 and accordingly cooperates with stop surface 106 to prevent continued manual withdrawal of shackle leg portion 18*a* past its thus established intermediate position into its unlocked position shown in FIG. 4*a''*. Of course, when an outwardly directed or pulling force on shackle 18 is released, spring 114 will serve to automatically return the parts of lock 10 into their positions shown in FIGS. 4*a* and 4*b*.

It will be understood that the described mode of operatively interconnecting locking plate 42 and shackle leg portion 18*a* is not limited in utility to padlocks or to use in combination with locking-unlocking mechanisms of the magnetically operated variety, since key or manual combination lock devices may be readily employed to control movements of the locking plate or similar member between its locking and unlocking positions. In this connection it will be appreciated that the manner of operatively interconnecting the bolt and the operator actuated locking-unlocking mechanism will be determined by the construction of the latter.

I claim:

1. A lock comprising in combination:

an operator actuated locking-unlocking mechanism including a member releasable under operator control for movement between locking and unlocking positions;

a lockable member movable between locked and unlocked positions, said lockable member having a recess, said recess defining a stop surface facing generally in the direction of movement of said lockable member towards said unlocked position and a cam surface facing generally towards said stop surface and in the direction of movement of said lockable member towards said locked position;

a bolt for operably interconnecting said member and said lockable member whereby to retain said lockable member in its locked position when said member is in its locking position and to free said lockable member for movement into its unlocked position when said member is in its unlocking position, said bolt being supported for rotary movements about an axis extending essentially transversely of the direction of movement of said lockable member and having first and second spaced portions thereof operably engaging with said member and said lockable member, respectively, said second portion of said bolt including stop means and cam-stop means, said bolt having a first rotatable position when said member is in said locking position wherein said cam-stop means is removed from within said recess and said stop means is inserted within said recess and arranged for engagement by said stop surface for preventing movement of said lockable member into said unlocked position, said bolt having a second rotatable position when said member is in said unlocking position wherein said stop means is removed from within said recess to permit movement of said lockable member towards said unlocked position and said cam-stop means is inserted within said recess, said cam-stop means when said bolt is in said second rotatable position being arranged for engagement by said stop surface to prevent movement of said lockable member beyond said unlocked position, said cam surface engaging said cam-stop means upon movement of said lockable member from said unlocked position towards said locked position for driving said bolt from said second rotatable position into said first rotatable position;

spring means tending to bias said lockable member towards one of said locked and unlocked positions; and spring means tending to bias said bolt for rotation from said first rotatable position towards said second rotatable position.

2. A lock according to claim 1, wherein the first of said spring means tends to bias said lockable member towards said unlocked position.

3. A lock according to claim 1, wherein the first of said spring means tends to bias said lockable member towards said locked position.

4. A lock according to claim 3, wherein said lockable member is supported for rotation about an axis aligned with the direction of movement thereof, said lockable member is formed with an annular groove communicating with said recess adjacent said stop surface, said groove being sized to receive said cam-stop means to permit rotational movements of said lockable member when in said unlocked position relative to said bolt, and engagement of said cam-stop means with said lockable member within said groove latching said lockable member from movement towards said locked position under the bias of said first of said spring means.

5. A lock according to claim 1, wherein said lock is adapted to be unlocked by a key having magnet devices, said member defines a plurality of openings, said mechanism includes in addition to said member a stationary mounting member, a plurality of magnetically attractable tumbler pins tiltably supported on said mounting member and having locking end portions thereof projecting towards said member and being movable to assume predetermined positions in alignment one with each of said openings of said member, said magnet devices when said key is applied to said lock magnetically attracting said tumbler pins for placing said locking end portions in said predetermined positions thereby to permit movement of said member from said locking position towards said mounting member and into said unlocking position, and additional spring means tending to bias said member from said unlocking towards said locking postion, the second of said spring means tending to exert on said member via said bolt a spring force in excess of the spring force exerted on said member by said additional spring means.

6. A lock according to claim 5, wherein the first of said spring means tends to bias said lockable member towards said unlocked position, said member and said lockable member and said bolt normally residing in rest-locked positions defined by engagement of said member with said locking end portions of said tumbler pins when one or more thereof do not assume said predetermined positions, said bolt when in said rest-locked position thereof having said stop means arranged within said recess in engagement with said stop surface and said cam-stop means arranged within said recess in spaced non-contacting relationship relative to said cam surface, said lockable member being manually movable from said rest-locked position thereof into said locked position against said bias of said first of said spring means, said cam surface coincident with movement of said lockable member from said rest-locked position thereof into said locked position engaging said cam-stop means for removing said cam-stop means from within said recess and thereby driving said bolt from said rest-locked position thereof into said first rotatable position against the bias of said second of said spring means, said additional spring means being operative when said bolt is in said first rotatable position to move said member from said rest-locked position thereof into said locking position thereby to free said locking end portions of said tumbler pins from engagement with said member and permit movement thereof by said magnet devices to assume said predetermined positions, said locking end portions when in said predetermined positions permitting conjunctive movement of said member from said locking position into said unlocking position and said bolt from said first rotatable position into said second rotatable position under said bias of said second of said spring means and said lockable member from said locked position into said unlocked position under said bias of first of said spring means.

7. A lock according to claim 5, wherein the first of said spring means tends to maintain said lockable member in said locked position coincident with which said bolt assumes said first rotatable position wherein said stop means is inserted within said recess and disposed in a spaced relationship with said stop surface and said cam-stop means is wholly removed from within said recess and disposed to engage said lockable member adjacent said recess thereby to retain said bolt in said first rotatable position against said bias of said second of said spring means, said member being biased into said locking position by said additional spring means when said bolt is in said first rotatable position, said lockable member being manually movable from said locked position against said bias of said first of said spring means into an intermediate position thereof wherein said recess is aligned with said cam-stop means to free said bolt for movement under said bias of said second of said spring means into an intermediate position thereof wherein both said cam-stop means and said stop means are inserted within said recess, movement of said bolt from said first rotatable position into said intermediate position thereof driving said member against the bias of said additional spring means from said locking position into an intermediate position thereof determined by engagement of said member with said locking end portions when one or more thereof do not assume said predetermined positions, said locking end portions when in said predetermined positions releasing said member and said bolt for movement beyond said intermediate positions thereof into said unlocking position and said second rotatable position, respectively, under said bias of said second of said spring means, said lockable member being movable from said intermediate position thereof into said unlocked position against the bias of the first said spring means when said bolt is in said second rotatable position.

8. A lock according to claim 7, wherein said lockable member is supported for rotation about an axis aligned with the direction of movement thereof, said lockable member is formed with an annular groove communicating with said recess adjacent said stop surface, said groove being sized to receive said cam-stop means to permit rotational movements of said lockable member when in said unlocked position relative to said bolt, and engagement of said cam-stop means within said groove latching said lockable member from movement towards said locked position under said bias of said first of said spring means.

* * * * *